United States Patent [19]

Falzone

[11] Patent Number: 4,489,703

[45] Date of Patent: Dec. 25, 1984

[54] ANTI-SMOG MEANS

[76] Inventor: Joseph S. Falzone, 62 Crescent Ct., Old Bethpage, N.Y. 11804

[21] Appl. No.: 451,243

[22] Filed: Dec. 20, 1982

Related U.S. Application Data

[63] Continuation-in-part of Ser. No. 284,480, Jul. 17, 1981, abandoned.

[51] Int. Cl.[3] ..... F02M 25/06

[52] U.S. Cl. ..... 123/568; 123/570

[58] Field of Search ..... 123/568, 570; 60/279

[56] References Cited

U.S. PATENT DOCUMENTS 3,166,060 1/1965 Falzone ..... 123/568

3,241,536 3/1966 Falzone ..... 123/568

3,892,070 7/1975 Bose ..... 60/279

*Primary Examiner*—Wendell E. Burns

*Attorney, Agent, or Firm*—James P. Malone

[57] ABSTRACT

Anti-smog means for internal combustion engines of the type having a fuel intake channel and an exhaust pipe. A pickup chamber is connected to the exhaust pipe. A tank is connected to the pickup chamber. The intake channel is connected to the tank to feed unburnt hydrocarbons from the pickup to the fuel intake channel. A curved box in the pickup facilitates separating unburnt hydrocarbons from water and solid particles in the engine exhaust. Positive cleaning manifold valve facilitates the separation of escaping loose hydrocarbons from water at sludge surge chamber of valve.

7 Claims, 9 Drawing Figures

ANTI-SMOG MEANS

This application is a continuation in part of Ser. No. 284,480, filed July 17, 1981 for ANTI SMOG MEANS now abandoned.

TECHNICAL FIELD

This invention relates to an anti-smog means for internal combustion engines and more particularly to means for reducing air pollution caused by automobiles and at the same time increasing the efficiency of automobile engines.

BACKGROUND ART

It is well known that the efficiency of internal combustion engines is quite low. One of the factors in this low efficiency is the lack of optimum mixing of the gasoline and air which results in incomplete combustion which represents a loss of potential energy and an increase in unburnt hydrocarbons, smoke and soot output from the exhaust, and carbon monoxide emission.

The air pollution caused by automobiles in large cities contributes greatly to the industrial smog which is a serious problem and which is becoming more acute as time goes on.

This invention is an improvement of my prior U.S. Pat. Nos., 3,166,060—granted Jan. 19, 1965 and 3,241,536—granted Mar. 22, 1966 of the same title.

THE INVENTION

The present invention provides a means for minimizing smog due to incomplete combustion of automobile engines by recirculating an unburnt portion of the exhaust gasses back through the engine. Therefore, the present invention not only minimizes smog and pollution but by the same process extracts extra energy out of the unburnt fuel so that the optimum condition is obtained whereby there is a maximum combustion and a minimum of waste products.

The present invention provides means in the pickup mounted in the exhaust to facilitate separating unburnt hydrocarbons from water and solid particles. The unburnt hydrocarbons are then fed back to be burnt in the engine.

OBJECTS OF THE INVENTION

Accordingly, a principal object of the invention is to provide new and improved fuel feeding and handling means for internal combustion engines.

Another object of the invention is to provide means to minimize air pollution or smog caused by automobile engines, which will fit any engine without modification.

Another object of the invention is to provide means to minimize air pollution or smog caused by automobile engines in combination with means to increase the mileage efficiency of automobile engines.

Another object of the invention is to provide means to minimize air pollution or smog caused by automobile engines in combination with means to increase the efficiency of automobile engines, including means to pick up the exhaust gasses to feed back an unburnt portion of the exhaust gasses through the intake manifold, and automatic valving to minimize back pressure.

Another object of the invention is to provide anti-smog means for internal combustion engines of the type having a fuel intake channel and an exhaust pipe, pickup means connected to said exhaust pipe, a tank connected to said pickup means, means connecting said intake channel to said tank to feed unburnt hydrocarbons from the pickup to the fuel intake channel, and means in the pickup means to facilitate separating unburnt hydrocarbons from water and solid particles in the engine exhaust.

Another object of the invention is to supply vacuum pressure to delta box nozzle 19 and tank B.

These and other objects of the invention will be apparent from the following specification and drawings.

BEST MODE OF THE INVENTION

Figures 1, 2:
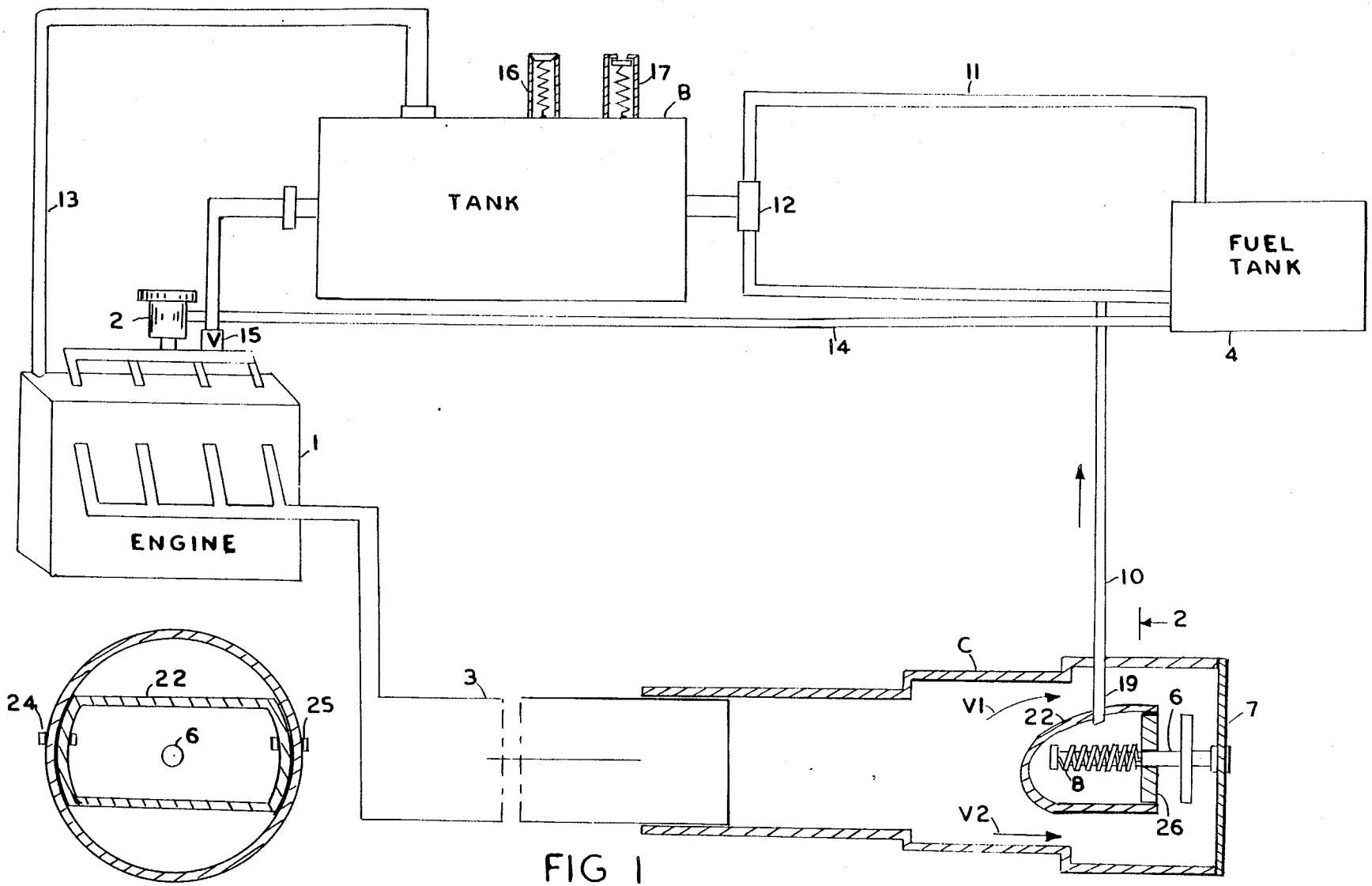
FIG. 1 is a schematic diagram partly in section of an embodiment of the invention.
FIG. 2 is a detail sectional view of FIG. 1.

Referring to the drawings, the engine 1, is conventional, it has a conventional carburetor 2, exhaust pipe 3 and fuel tank 4.

The pickup chamber C is mounted on the end of the exhaust pipe. Mounted in the chamber C generally along the central axis of the chamber C is a curved air foil box 22 called a delta box. The curved box member 22 is closed and attached to chamber C at each side. Mounted in the box 22 is a valve shaft 6 of valve 7. The spring 8 is pre-set so as to hold the valve 7 so that it will open due to exhaust pressure.

The chamber C is also connected by means of the pipe 10 which is connected to tee connection 12, which is connected to the tank B. Fuel tank vent 11 connects the top of the fuel tank to the other side of the tee connection 12. The crank case is also vented into the tank B by means of the pipe 13. The fuel tank 4 feeds fuel in conventional manner through the carburetor through the pipe 14. The manifold valve 15 is responsive to manifold pressure and feeds unburnt hydrocarbons to the induction system from the tank B and supplies vacuum pressure to flow line nozzle 19 and assures escaping loose hydrocarbons are free. Sludge chamber of P C valve 15 requires cleaning.

The tank B collects unburnt hydrocarbons from the crank-case case vent 13, the exhaust return 10 and the fuel tank vent 11. Relief valve 16 limits the pressure in the tank B, for instance, due to backfiring. The valve 17 is a negative pressure relief valve which assists in maintaining proper air and fuel ratio and to prevent buckling of the tank.

In an alternative arrangement, in a conventional automobile, the tank B can be eliminated and the pipe 10 connected directly to the air intake of the engine and the operation will be substantially similar to the arrangement with the tank B.

The general operation is that the lighter unburnt hydrocarbon in the exhaust will become disassociated in the chamber C especially due to the action of the box 22 which speeds up the flow VI at the top of the chamber.

FIG. 2 shows a sectional view through the delta box assembly 22. The delta box is connected to the sides of the chamber C by means of bolts 24, 25. The block 26 is fixedly connected to the delta box. The valve shaft 6 is mounted in the block 26 preferably with a bushing. The valve 7 is mounted on the end of the shaft 6 and the spring 8 is mounted on the other end of the shaft 6. The shaft 6 has a vent keyway 6' which operates to ventilate the delta box in the cruising position shown in FIG. 4. The flow line nozzle 19 is connected to the line 10 and extends down into the delta box 22.

Figure 3:
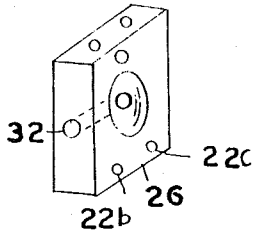
FIG. 3 is an exploded perspective view of the delta box and valve assembly.
Figure 3:
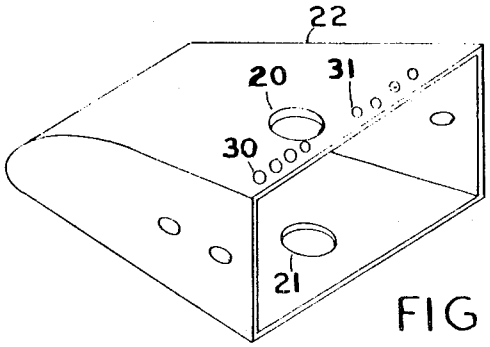

FIG. 3 shows an exploded view of the delta box 22 which has an air foil shape. The box 22 has an upper dump port 20 and a lower dump port 21 and has a plurality of bleed holes 30, 31, etc., for bleeding action of hydrocarbons due to V1 and V2 flows. The block 26 is fixedly connected to the box 22 and has a shaftway 32 in which is mounted a pin 33, which extends through the vent keyway 6' in the shaft 6. This prevents the shaft 6 from rotating in shaftway 32 which mounts valve shaft 6 and trim bar 9.

Figure 4:
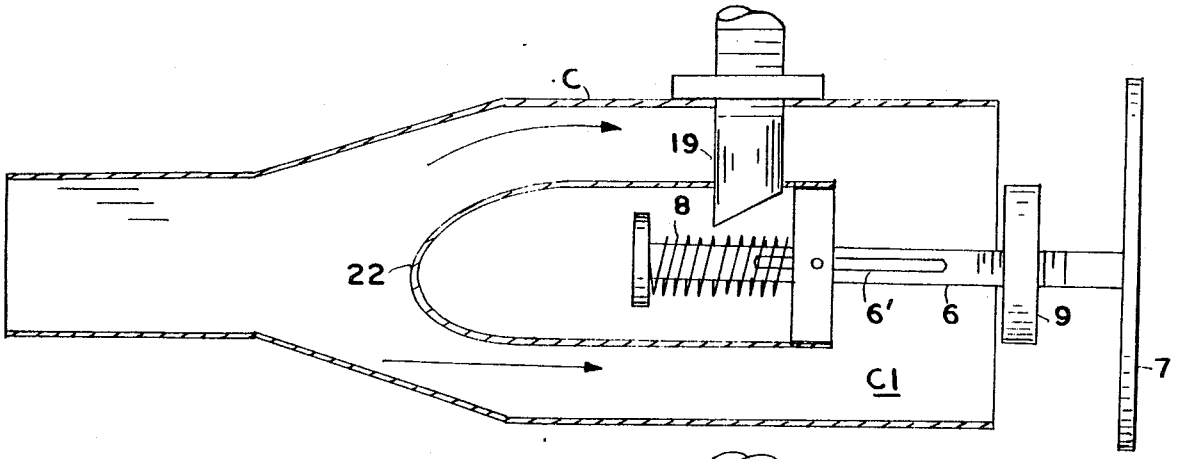
FIG. 4 is a sectional view of the delta box and valve assembly in the cruise position.

FIG. 4 shows the delta box 22, trim bar 9 and valve 7 assembly in cruise position. The V1 flow flows over the top of the air foil shaped box 22 and the flow V2 flows along the bottom into the master dump area C2 of the chamber C. In the cruise position shown in FIG. 4, the pressure flow opens the valve 7 and the trim bar 9 takes the place of the valve 7 in order to maintain V1 and V2 flows. In the idle position shown in FIG. 5, the valve 7 is closed by the spring 8 and decreases the size of the master dump chamber, to assure feed back since exhaust pressure flow is weak and manifold pressure is low.

Figure 6:
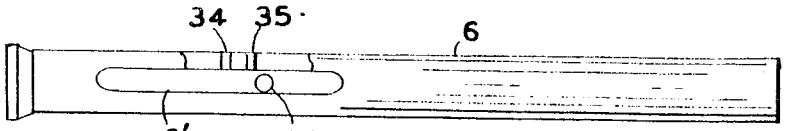
FIG. 6 is a detail view of the valve shaft.

FIG. 6 shows a detail view of the valve shaft 6 having the keyway vent 6' through which extends the pin 33. A pair of bleed holes 34, 35, extend into the keyway for the purpose of ventilating the delta box as will be explained.

Figure 7:
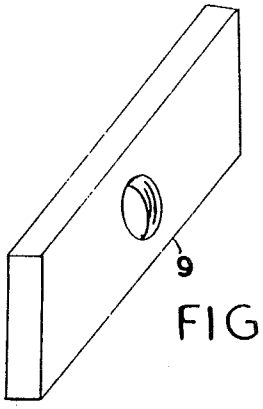
FIG. 7 is a detail view of the trim bar.

FIG. 7 shows a detail view of the trim bar 9.

Figure 8:
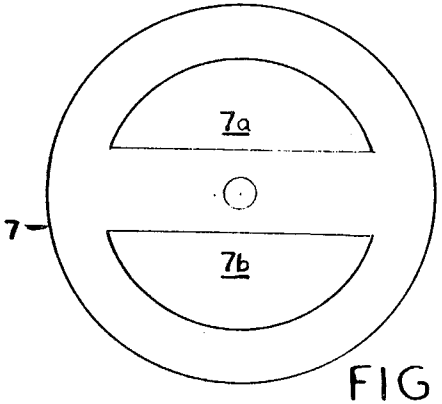
FIG. 8 is a detail view of the valve.

FIG. 8 shows a detail view of the valve 7 showing the V1 port 7*a* and the V2 port 72.

Figure 9:
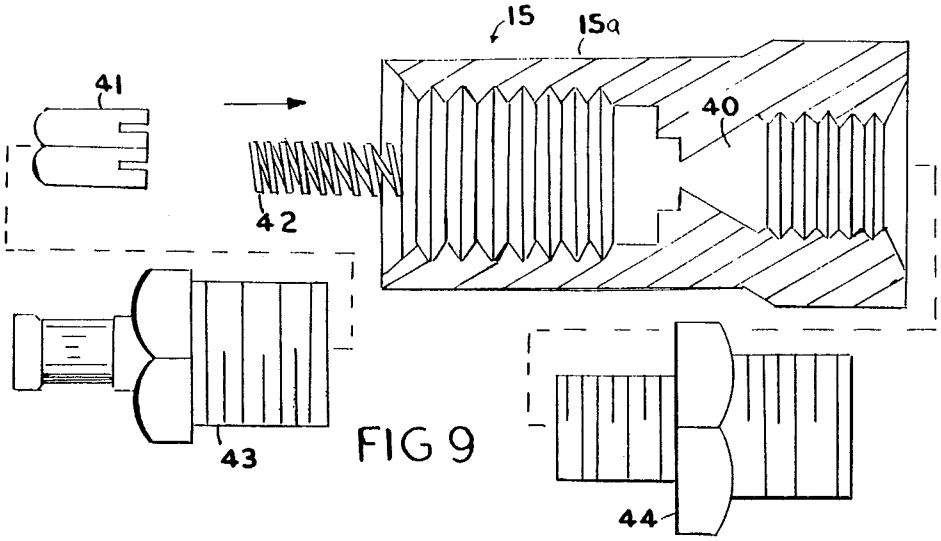
FIG. 9 is a diagram of the PC valve.

FIG. 9 shows a diagram of the PC valve 15 which comprises a body member 15*a* which is shaped to form a sludge chamber 40, which can be cleaned periodically. The flow is in the direction of the arrow. The cap 41 is inserted in the body over the spring 42 and secured by the outer threaded cap 43. The other end of the body 15*a* is secured by the cap 44 which is mounted at the input of the engine. Cap 41 is slotted to provide smaller flows.

The shaft support of parent application Ser. No. 284,480 was removed due to flow characteristics deflecting off shaft support and building back pressures that foil V1 and V2 flows.

The shaft 6 rides in block 26 attached to aft end of delta box. The delta box 22 is secured to side attachment points of housing C. The shaft keyway vent 6' that prevents valve rotation is a vent. The top side of shaft has vacuum bleed holes that penentrates into keyway for idle and maximum power position.

The delta box is curved, to provide a clinging surface for the unburnt hydrocarbons, and water, and to build a negative pressure top side, which reduces impact pressure on clinging hydrocarbons.

The shaft block 26 has vent holes 22*b*, 22*c*, that aid in creating a cyclonic effect for feed back of loose hydrocarbons and prevents cell build-up aft of block 26 that will disorganize the feed back of free hydrocarbons.

The shaft 6, vent keyway 6' ventilates the master dump chamber C1 of unburnt hydrocarbons aided by vacuum from vacuum bleed holes on shaft 6 in idle position.

The speed V1 of discharge flow is greater along leading edge of air foil shaped box, topside, than speed V2 bottom side, with restricted containment of housing C providing a contained volume.

In order that both flows V1 and V2 to meet at trailing edge simultaneously, the V1 flow increase in speed and creates a negative pressure, top side of V1 dump port 20, for initial disassociation of hydrocarbons. V2 dump port bottom side is completely opened and assures run off of water mated with burnt specifics or sludge.

Rapid disassociation takes place at V1 dump port 20 due to shielding action on stationary cell inside delta box 22.

V2 dump port 21 bleeds out water and heavy burnt specifics by the V2 flow on outer wall of plate 22.

V1 flow, top side, bleeds out unburnt hydrocarbons according to their specifics from stationary cell 22 due to flow action of V1 flow, before entry into master dump chamber C1.

Loose and free hydrocarbons have a tendency to cling to water particles during flow on delta box curved plate.

At trailing edge of delta box, most of the loose hydrocarbons separate from water particles in master dump chamber C1 due to negative pressure created by V1 and V2 passing flows and position of trim bar 9.

The flow line nozzle 19 gathers all free and loose hydrocarbons passing nozzle 19 from stationary cell in delta box. Loose passing hydrocarbons that are carried on water particles are separated, caused by negative pressure within box and passing V1 and V2 flows and negative pressure from PC valve 15.

The water mated with burnt specifics is discharged at V2 dump port before hydrocarbon entry into surge tank B. Most water particles are mated with burnt specifics.

Trim bar 9 which maintains V1 and V2 flows, also increases and decreases size of master dump chamber C1 due to flow action on valve.

At high power settings, the clinging hydrocarbons needs a larger dump chamber to separate the clining hydrocarbons from the water particules. Force of exhaust delays action.

A principle of physics known as the Coanda Effect is seen when a liquid or gas flowing over a curved surface tends to cling to the surface and follow its curvature.

Due to negative pressures built within box 22 from passing V1 and V2 flows and vacuum pressure from flow line nozzle 19 that is supplied by PC manifold valve 15, and that penetrates into V1 dump port of delta box 22, at all power settings at trailing edge of delta box, the V1 and V2 flow bend with a reverse flow and feed the unburnt hydrocarbons according to their specifics, into delta box.

At all power settings above idle, FIG. 4, the valve is completely opened and the valve trim bar 9 maintains normal V1 and V2 flow operations. The trim bar 9 works independent of valve 7, and is adjustable on threaded shaft 6.

Figure 5:
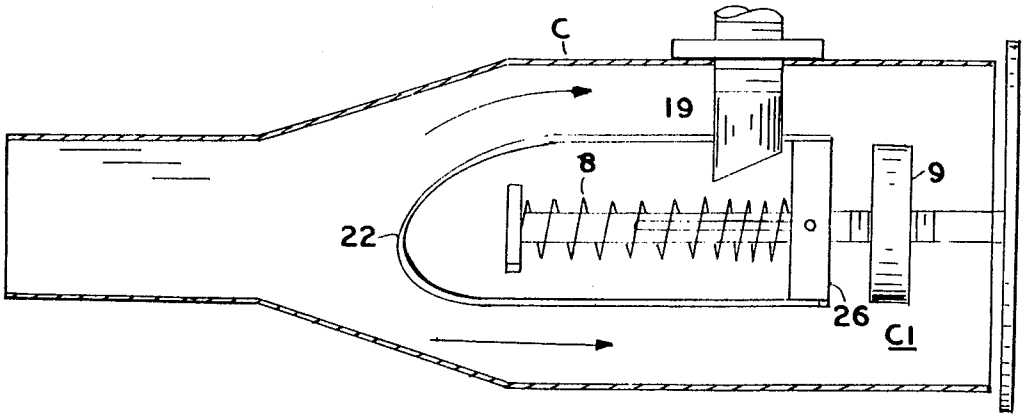
FIG. 5 is a sectional view of the delta box and valve assembly in idling position.

During idle speeds, FIG. 5, the valve 7 is closed. The master dump chamber C1 that is located from trailing edge of delta box to leading edge of V1 and V2 delta box trim bar 9 that discharges the heavy specifics and bleeds off any pressures through V2 port of valve spar 17.

The trim bar 9 works in conjunction with delta box increasing and decreasing master dump chamber area C1, according to power settings. The valve shaft 6 rides on vent keyway 6' to assure anti-rotation on valve.

The V1 and V2 dump ports 20 and 21 are flow directional dumps of less resistance due to negative pressure within box 22 supplied by PC manifold valve. Trim bar 9 also takes the place of valve 7 at high power settings in order to maintain normal V1 and V2 flows.

At settings above idle, FIG. 4, the valve shaft 6 keyway vent 6', ventilates the master dump chamber C1 for all clinging hydrocarbons, after disassociation takes place, before water discharge.

The valve shaft 6, keyway vent 6' is partially closed during high power settings, FIG. 4, for normal scavenging of delta box from flow line nozzle 19. Due to higher negative pressure from flow line nozzle 19 and greater V1 and V2 flows, the vent 6' is partly closed.

The valve shaft keyway vent 6' is completely opened during low power settings in order to ventilate the delta box.

Open and closed position of vent depends on keyway vent 6' and vent bleed holes 34 and 35, vent location, riding on valve shaft 6 in block 26 attached to aft end of delta box 22.

The speed of discharge flow V1 is greater along leading edge of air foil shaped box 22, topside, than speed V2 bottom side with restricted containment of housing.

In order that both flows V1 and V2 to meet at trailing edge simultaneously, the V1 flow increases in speed and creates a negative pressure, top side of V1 dump port, for initial disassociation of hydrocarbons. V2 dump port 21 bottom side is completely opened and assures run off of mated water for discharge.

Rapid disassociation takes place at V1 dump port 21 top side due to shield action of delta box 22 on stationary cell inside it.

V2 dump port 21 bleeds out water and heavy burnt specifics by the V2 flow on outer wall of box 22.

V1 flow, top side bleeds out unburnt hydrocarbons according to their specifics from stationary box 22 due to flow action of V1 flow before entry into dump chamber. Loose and free hydrocarbons have a tendency to cling to water particles during flow on delta plate.

At trailing edge of delta box 22, most of the loose hydrocarbons separate from water particles in master dump chamber C1 due to negative pressure created by V1 and V2 passing flows and position of trim bar 9.

The flow line nozzle 19 gathers all free and loose hydrocarbons passing nozzle 19 from stationary cell in delta box.

Loose passing hydrocarbons that are carried on water particles are separated.

The mated water is discharged at V2 dump port 20 before hydrocarbon entry into surge tank B. Most water particles are mated with burnt specifics.

Prototype positive cleaning manifold valve 15 which is responsive to manifold pressure feeds back unburnt hydrocarbons to the induction system from tank B and supplies required negative pressure to flow line nozzle 19 to gather free and loose hydrocarbon from stationary cell in delta box 22.

Referring to FIG. 9, the sludge surge chamber **15*a* within valve 15 assures escaping loose hydrocarbons are free of sludge before entry into induction systems of the engine. Flow slots 15*b*** aid cleaning by separation of mass flow into smaller flows.

It is claimed:

1. Anti-smog means for internal combustion engines of the type having a fuel intake channel and an exhaust pipe, pickup means connected to said exhaust pipe, a tank connected to said pickup means, means connecting said intake channel to said tank to feed unburnt hydrocarbons from the pickup to the fuel intake channel, and means in the pickup means to facilitate separating unburnt hydrocarbons from water and solid particles in the engine exhaust, wherein the means to facilitate separating unburnt hydrocarbons from water and solid particles comprises an air foil shaped curved box mounted along the central axis of the exhaust pipe.

2. Apparatus as in claim 1 having a spring loaded valve connected to the end of the exhaust pipe.

3. Apparatus as in claim 1 wherein the curved box has upper and lower dump ports.

4. Apparatus as in claim 2 wherein the curved box has upper and lower dump ports.

5. Apparatus as in claim 2 having a valve shaft mounted in the curved box.

6. Apparatus as in claim 5 wherein the valve shaft has a keyway which ventilates the interior of the curved box.

7. Apparatus as in claim 6 having a tank connected in the fuel intake channel, a manifold connected in the fuel intake channel and a manifold valve responsive to manifold pressure attached between the tank and the manifold to supply vacuum to the tank and curved box.

* * * * *